US005634603A

United States Patent [19]

Raasch et al.

[11] Patent Number: 5,634,603

[45] Date of Patent: Jun. 3, 1997

[54] SERVICE ARRANGEMENT FOR A TEXTILE MACHINE FOR PRODUCING WOUND YARN PACKAGES

[75] Inventors: Hans Raasch; Heinz-Dieter Göbbels; Hans-Willi Esser, all of Mönechengladbach, Germany

[73] Assignee: W. Schlafhorst AG & Co., Moenchengladbach, Germany

[21] Appl. No.: 538,192

[22] Filed: Oct. 2, 1995

[30] Foreign Application Priority Data

Oct. 11, 1994 [DE] Germany ..... 44 36 274.9

[51] Int. Cl.[6] ..... B65H 54/02; D01H 9/14

[52] U.S. Cl. ..... 242/35.5 A; 57/281

[58] Field of Search ..... 242/35.5 A, 18 PW, 242/18 R, 46, 49; 57/266, 281

[56] References Cited

U.S. PATENT DOCUMENTS

| | | | |
|---|---|---|---|
| 3,741,490 | 6/1973 | Venot | 242/35.5 A X |
| 4,139,162 | 2/1979 | Stahlecker | 242/35.5 A |
| 4,610,405 | 9/1986 | Noshi | 242/35.5 A |
| 4,923,132 | 5/1990 | Hirai et al. | 242/35.5 A |
| 5,165,615 | 11/1992 | Polnik | 242/35.5 A |
| 5,168,695 | 12/1992 | Stahlecker | 57/281 |
| 5,248,103 | 9/1993 | Polnik | 242/18 PW |
| 5,495,991 | 3/1996 | Raasch et al. | 242/35.5 A |

FOREIGN PATENT DOCUMENTS

| | | |
|---|---|---|
| 0 106 809 A1 | 4/1994 | European Pat. Off. . |
| 28 16 418 A1 | 10/1979 | Germany . |
| 37 26 508 A1 | 12/1988 | Germany . |
| 38 01 965 A1 | 7/1989 | Germany . |
| 40 01253 A1 | 7/1991 | Germany . |
| 42 00 079 A1 | 7/1993 | Germany . |
| 43 13 523 A1 | 10/1994 | Germany . |
| 44 02 143 A1 | 10/1994 | Germany . |

*Primary Examiner*—Michael Mansen
*Attorney, Agent, or Firm*—Shefte, Pinckney & Sawyer

[57] ABSTRACT

An open-end rotor spinning machine is equipped with a service structure for the automatic correction of yarn breaks occurring in the course of the bobbin winding and for the automatic exchange of empty tubes for finished packages, wherein empty tubes are delivered to and finished packages are removed from the work stations via an endless transport device. The service structure has a package ejector for ejecting finished packages from the work stations, a tube gripper for retrieving an empty tube from the transport device, and a tube positioning device connected with the package ejector of the service structure to position an empty tube held by the tube gripper precisely into desired disposition relative to a respective work station to be supplied with an empty tube.

14 Claims, 6 Drawing Sheets

SERVICE ARRANGEMENT FOR A TEXTILE MACHINE FOR PRODUCING WOUND YARN PACKAGES

FIELD OF THE INVENTION

The invention relates to a textile machine for producing yarn packages, especially cheese-type packages, and more particularly to a service arrangement for the automatic exchange of finished packages for empty tubes, wherein the provision and removal processes at the textile machine take place via an endless transport device.

BACKGROUND OF THE INVENTION

Service arrangements for textile machines which can repair yarn breaks as well as perform yarn package changes are known, for example, from German Patent Publication DE 38 01 965 A1 or European Patent Publication EP 0 106 809 B. In addition to a pneumatically or mechanically operating auxiliary yarn transport device, these service arrangements have special yarn spinning units as well as a package changing device with means for passing the finished packages to a transport device, and a gripper device for inserting empty tubes into the bobbin frame of the respective work station.

It is furthermore known to employ an endless transport device for delivering empty bobbins and removal of wound packages at the work stations of yarn winding textile machines. Such an endless transport device is represented in German Patent Publication DE 40 01 253 A1, which has a conveyor extending along the longitudinal extent of the textile machine disposed between the work stations along opposite sides of the machine. The conveyor has gondola-like carrier elements for transferring the wound packages and separate holders for receiving empty tubes.

A further development of the transport device known from German Patent Publication DE 40 01 253 A1 is described in the subsequently published German Patent 43 13 522.6 (which corresponds to U.S. Pat, No. 5, 495, 991). The bobbin-producing machine represented in this publication has two rows of work stations extending in the linear direction of the machine and a transport device arranged centrally between these rows. The transport device is designed as an endlessly circulating conveyor including a plurality of transport units combined into a transport chain, each having a transport receptacle freely accessible from above. The transport receptacles are designed in such a way that they can receive an empty tube as well as a package.

The unloading or loading of the transport units at the work stations of the textile machine is performed by means of an independent service arrangement movable along the machine. Among other things, the service arrangement has a tube gripper which can be directly controlled via a control device. When exchanging a finished package for an empty tube, the tube gripper first takes up the empty tube from the transport receptacle of the transport unit and transfers it into an intermediate position. The package is subsequently pushed into the transport receptacle of the transport unit positioned at the respective work station by additional manipulating elements arranged on the service arrangement, such as frame openers and bobbin ejectors. Thereafter the tube gripper delivers the empty tube to the bobbin frame of the respective work station. In the process, the transfer of the empty tube takes place in a predetermined bobbin frame position in which the tube support arms are lifted off the winding drum of the winding device.

The tube gripper of the service arrangement is embodied either as a telescopic gripper or a boom gripper which is rotatably fastened on a bracket disposed at a distance above the transport device.

SUMMARY OF THE INVENTION

It is accordingly an object of the present invention to provide an improvement in the empty tube transfer operation performed at the work stations of yarn package-producing textile machines by automatically operating service arrangements.

The present invention is essentially adapted to any basic yarn package-producing textile machine having multiple work stations each equipped with a bobbin tube support frame, an endless transport arrangement for delivering empty tubes to the work stations and for removing finished yarn packages from the work stations and a service structure movable between the work stations for performing replacement of finished packages with empty tubes. According to the present invention, the service structure is equipped with a tube gripper for retrieving an empty tube from the transport arrangement and a tube positioning device for orienting the empty tube, while gripped by the tube gripper, into an exact position relative to the tube support frame of a respective work station to be supplied with the empty tube, thereby to prepare the tube to be transferred to the support frame.

In the preferred embodiments of the invention, the service structure includes a package ejector for displacing finished yarn packages from the work stations of the machine and the tube positioning device includes two opposing pivotable positioning arms which are connected via a connecting linkage to the package ejector of the service structure. The connecting linkage is arranged to pivot the positioning arms, simultaneously with actuation of the package ejector, into a predetermined position wherein the positioning arms are aligned in a positionally exact relation to the tube support frame of a respective work station to be supplied with an empty tube.

Preferably, the tube positioning device includes a pivot shaft rotationally supported in generally vertical disposition on the service structure and connected with the package ejector by an eccentric drive linkage, with one of the positioning arms fastened on the pivot shaft and the other positioning arm pivotably seated on a bracket and connected with the pivot shaft by means of another drive linkage.

The positioning arms may have cone-shaped centering projections for insertion into axial end openings of an empty tube. The connecting linkage may include means for yielding to overloading forces on the connecting linkage. It is further preferred in each embodiment of the invention that the tube positioning device includes a monitoring device connected to a control device for the service structure for monitoring the disposition of the positioning arms.

In one possible embodiment, at least one of the two positioning arms comprises multiple arm portions including a support arm portion and an end arm portion pivotably fastened on the support arm portion and a spring biasing element for urging the arm portions into a predetermined relative position. At least one positioning arm includes a stop element disposed on the support arm portion for limiting pivotal movement of the end arm portion and for bracing the end arm portion.

The tube gripper may include a centering projection and the tube support frame of each work station may include a centering receptacle for receiving the centering projection when the tube gripper is disposed at the tube support frame. The centering projection and the centering receptacle are cooperatively configured and arranged to assure that an empty tube held in the tube gripper is positioned coaxially relative to the axis of rotation of the tube support holder. Preferably, the centering receptacle disposed on the tube support frame is shaped as a fork and the centering projection on the tube gripper is shaped as a finger.

Thus, the tube positioning device in accordance with the present invention has the fundamental advantage that all empty tubes which are presented by the tube gripper of the service arrangement to the individual tube support frames at the work stations of the machine are always exactly oriented in relation to the respective bobbin frame. In the process, it is assured by means of the tube positioning device that misplacements, which can occur, for example, because of repeated approaches of the transport device during transport of the empty tubes to the work stations, are dependably compensated.

In an advantageous embodiment of the invention, the tube positioning device has two pivotably arranged positioning arms which are connected with the package ejector of the service arrangement and arranged in such a way that the empty tube conveyed by the tube gripper into the area of the positioning device is acted upon by the positioning arms in the axial direction so as to be brought into a predetermined position. In this case the positioning arms are preferably connected with the package ejector such that, when the package ejector is pivoted outwardly, i.e., in the course of pushing a finished package from the bobbin frame, the positioning arms are simultaneously pivoted inwardly.

In a preferred embodiment, the connecting arrangement comprises a vertically disposed pivot shaft which is rotatably supported by bearings on the service arrangement. A pivot lever is fastened, preferably by frictional connection, at the lower end of the pivot shaft and is eccentrically connected via a bar linkage to the package ejector shaft. One of the two positioning arms is disposed, also preferably by frictional connection, in the upper area of the pivot shaft, and a second, length-adjustable bar linkage is connected by means of a further pivot lever. This bar linkage is furthermore connected with the second positioning arm which, in turn, is rotatably seated on a bracket.

According to a further embodiment of the invention, at least one of the positioning arms is designed to be in several parts. In this case a front arm portion which, for example, has a tube support surface, is pivotably fastened on a rear support arm portion and is acted on via a spring element in an inwardly pivoting direction. A rear stop limits the pivot travel of the arm piece toward the rear and in this way assures that after a defined pivot travel the positioning arm is braced and therefore the respective tube support surface is pivoted inwardly via the connecting arrangement into the predetermined tube engaging position.

In an advantageous embodiment the tube positioning device additionally has a monitoring device connected with the control device of the service arrangement. The monitoring device monitors the positioning arms to determine whether they have reached the predetermined tube orienting position, i.e., whether the empty tube is properly oriented in respect to the bobbin frame of the respective work station.

The monitoring device is particularly advantageous in connection with cone-shaped centering projections on the positioning arms. In the course of the positioning process it is possible by means of such cone-shaped centering projections to remove dents from tubes which had been slightly dented at their ends and to make them further available for yarn production. Tubes which must be removed because of extensive damage at their ends become noticeable in that the positioning device cannot assume its predetermined tube orienting position. This erroneous positioning is detected by the monitoring device and is reported via the control device to the service structure.

According to a further advantageous feature of the invention, the tube gripper is guided by means of a positioning aid when transferring the empty tube to the bobbin frame. The gripper element of the tube gripper has a finger-like centering projection for this purpose, which glides into a correspondingly shaped centering receiver on the bobbin frame when the gripper element moves into the tube transfer position, i.e. into a position in which the bobbin frame receivers are disposed at a distance from the yarn guide drum.

DETAILED DESCRIPTION OF THE PREFERRED EMBODIMENT

Figure 1:
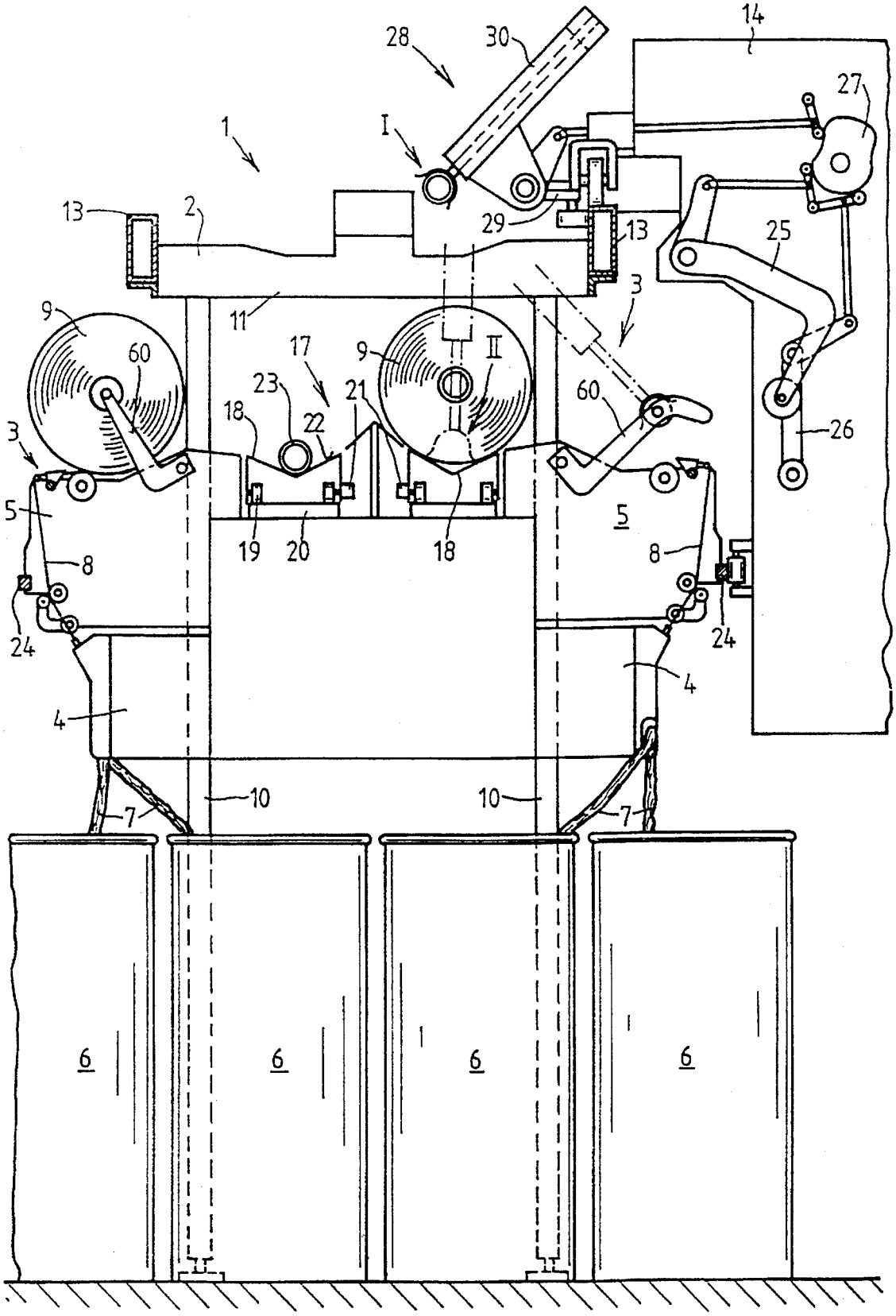
FIG. 1 is an end elevational view of a textile yarn package-producing machine equipped with a circulating endless transport device for delivery of empty winding tubes to and removal of wound packages from the work stations of the machine, and with an automatic service arrangement patrolling along the work station.

A textile machine for producing cheeses or another like form of wound yarn package is identified in its entirety by 1 in FIG. 1, and for sake of illustration and by way of example is shown as an open-end rotor spinning frame. Open-end spinning frames of this type essentially comprise a main machine frame 2 with multiple work stations 3 arranged in alignment with one another to extend in two rows along opposite longitudinal sides of the machine. Each of the work stations 3 has a respective spinning unit 4 and a winding device 5, which are basically known and therefore not shown in detail. At each spinning station, a sliver 7 disposed in a sliver can 6 is fed into the respective spinning unit 4 to be spun into yarn, from which the yarn is withdrawn and subsequently wound into a cheese-type package 9 in the winding device 5.

Usually the main machine frame has a plurality of vertical support stanchions 10, which are connected via transverse cross arms 11 and horizontal struts. Horizontal longitudinally extending guide rails 13 are disposed on the transverse cross arms 11 for traveling movement therealong of one or several automatic service structures 14.

Figure 2:
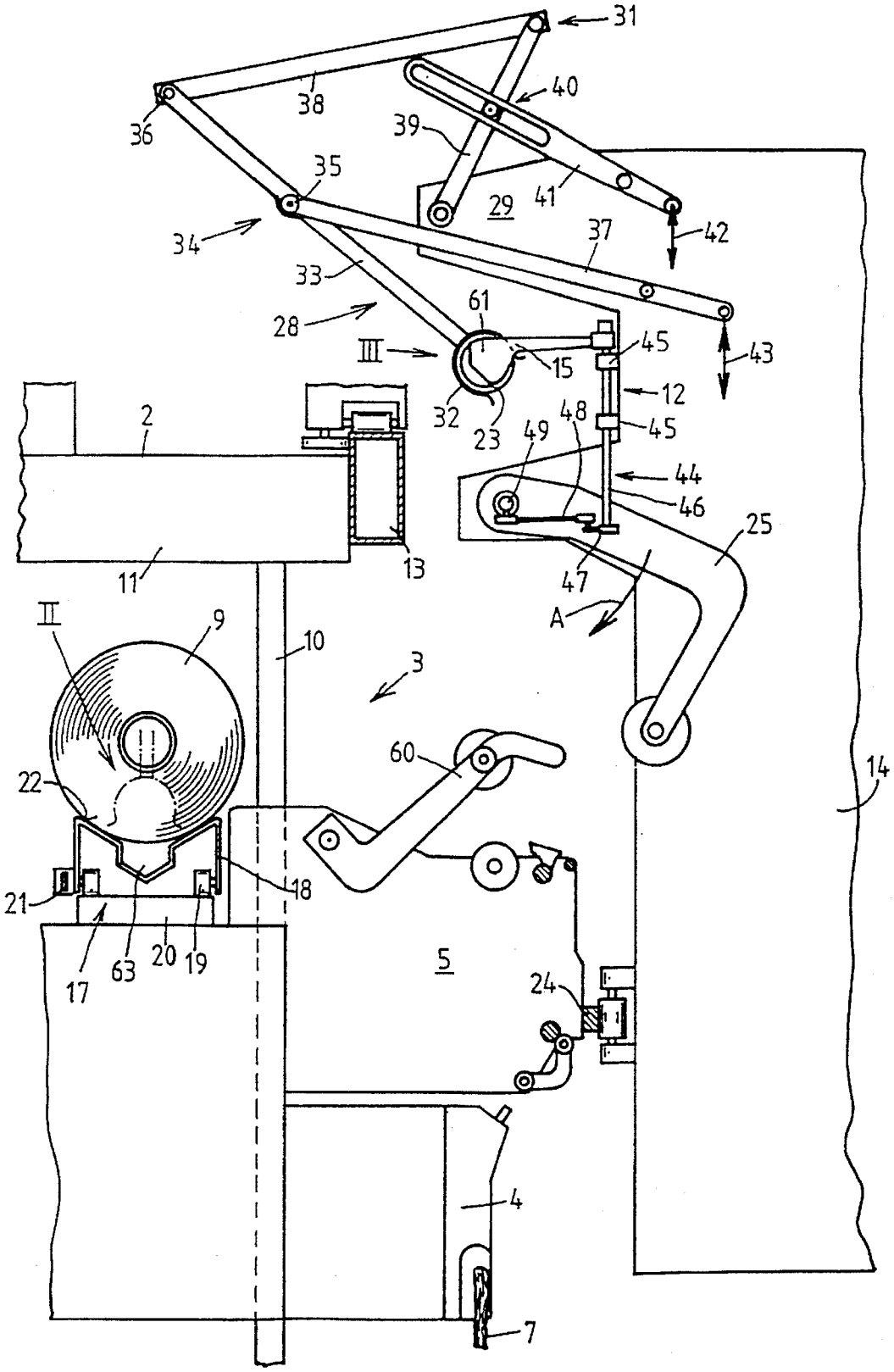
FIG. 2 is an end elevational view similar to FIG. 1 showing a traveling service arrangement with a tube positioning device in accordance with the present invention.

A transport arrangement 17 extends along the length of the machine between the respective winding devices 5 of the two rows of work stations in the area beneath the transverse cross arms 11 and between the transverse cross arms 11 and the central machine frame. The transport arrangement 17 comprises a plurality of individual transport units 18 which circulate in aligned sequence with one another on a track 20, for example by means of wheeled running gear 19 on the interior underside of each unit. The transport units are either embodied as independent pushed elements or, as shown in FIGS. 1 and 2, combined into a circulating endless transport device by means of a connecting traction element 21 which is activated by a drive wheel (not shown). Each of the transport units 18 has a generally V-shaped upwardly facing transport receptacle 22 which can selectively receive either an empty tube 23 or a fully wound package 9.

An automatic service structure 14 is supported on the guide rail 13 disposed in the area of the transverse cross arms 11 for traveling movement along the work stations 3. As can be seen in FIG. 1, the service structure 14 is further supported in lateral engagement with a support rail 24 disposed on the winding devices 5. The service arrangement 14 is equipped with a number of manipulating devices, of which only a tube gripper 28, a package ejector 25 and a tube support frame opener 26 are indicated.

The manipulating motions of the package ejector 25, the frame opener 26, and the tube gripper 28 are actuated in a known manner by means of a disc cam mechanism 27. The tube gripper 28 is disposed, for example, on a bracket 29 above the guide rail 13 on the transverse cross arms 11. As shown in FIG. 1, the tube gripper 28 can be designed as a telescopic gripper 30 or, as shown in FIG. 2, as a boom gripper 31. In the preferred embodiment of the tube gripper shown in FIG. 2, the actual tube gripping element 32 is fastened at the end of a boom 33, which itself is a component of a steering linkage assembly indicated as a whole by 34. The boom link 33 has spaced hinge points 35 and 36 along its end opposite the tube gripping element 32, a support and control link 37 supported on the bracket 29 being connected to the hinge point 35 while a control lever 38 is connected to the hinge point 36 and is indirectly connected via an intermediate guide element 39 with the bracket 29. In turn, the intermediate guide element 39 is connected via a length compensating link 40 with an actuating lever 41. The support and control link 37 and the actuating lever 41 are connected via a mechanical force transmission means, for example connecting rods indicated only representatively at 42, 43, to a control device, for example a disc cam mechanism, not represented in FIG. 2.

FIG. 2 furthermore shows a tube positioning device 12 in accordance with the invention, disposed above the package ejector 25. The tube positioning device 12 is further represented in a top plan view in FIG. 3. An alternate exemplary embodiment of such a tube positioning device is shown in a similar top plan view in FIG. 4.

Figure 3:
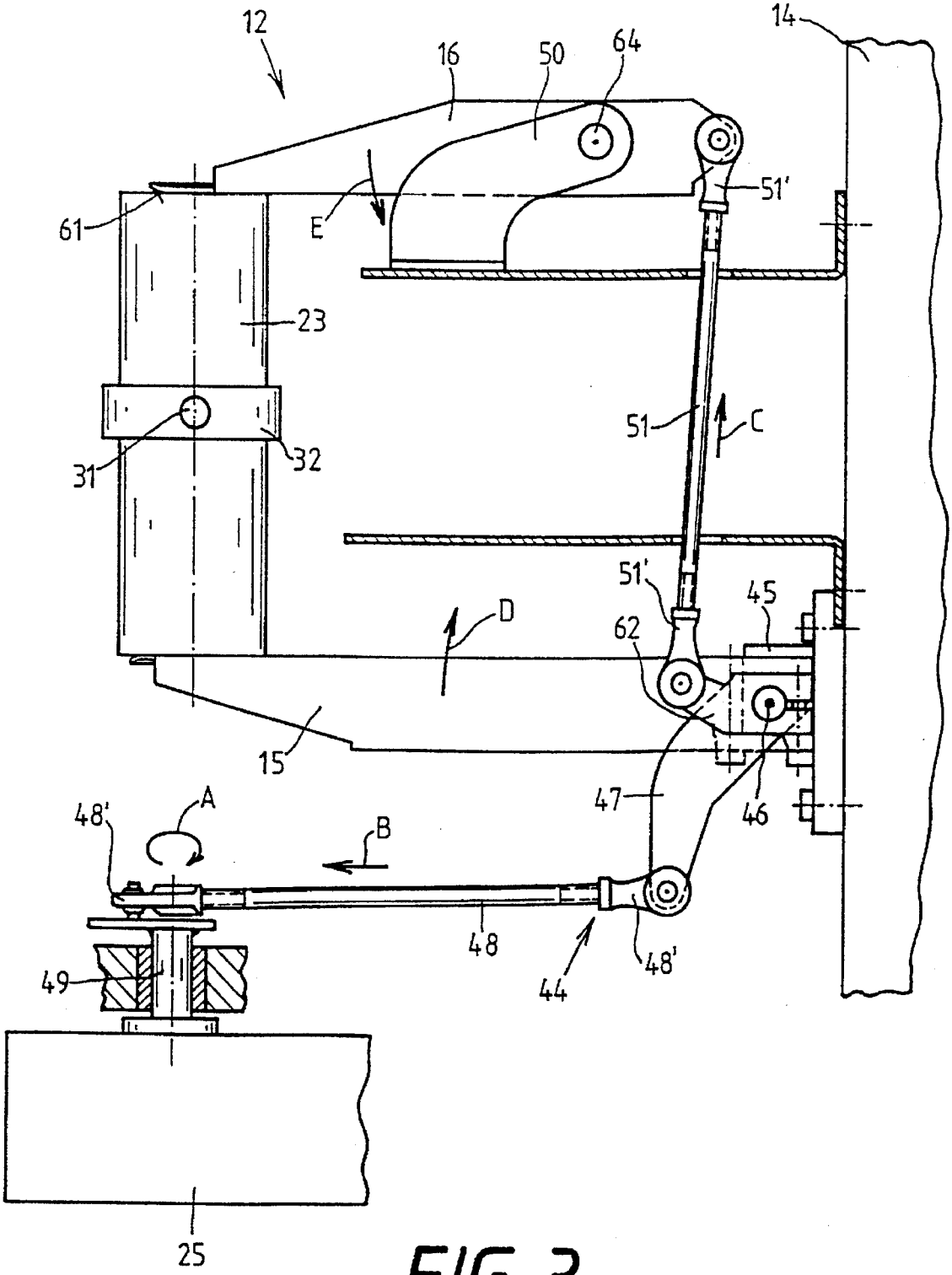
FIG. 3 is a top plan view of the embodiment of the tube positioning device of FIG. 2.
Figure 4:
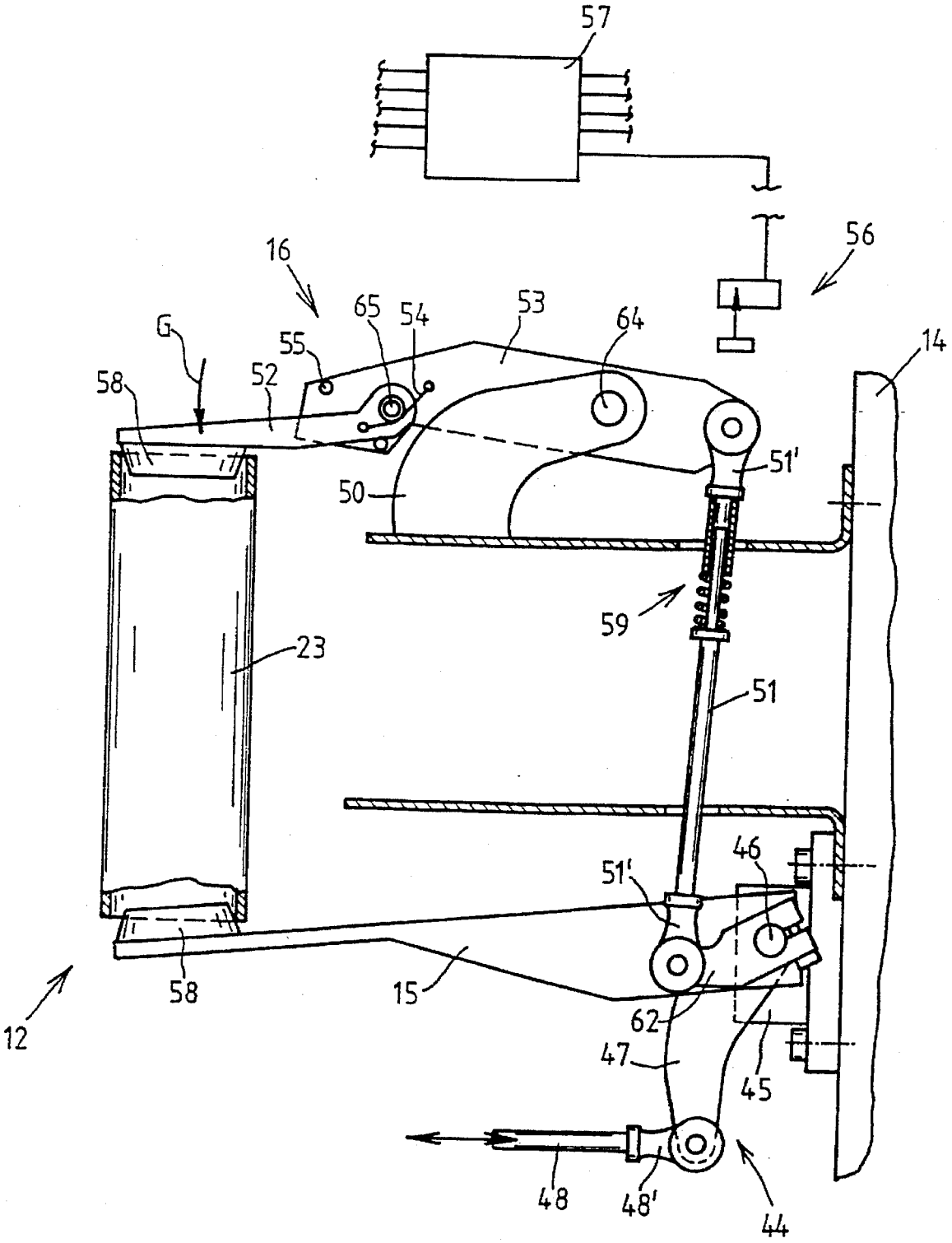
FIG. 4 is another plan view of a second embodiment of the tube positioning device.

As can be seen from FIGS. 2, 3 and 4, the tube positioning device 12 has two positioning arms 15,16, which can be laterally placed against the opposite axial ends of an empty tube 23 and which are operationally connected with the package ejector 25 via a connecting arrangement, indicated as a whole by 44. The positioning arms have either smooth tube contacting surfaces 61 on their ends (FIGS. 2 and 3), which can be placed against the axial end faces of the tube, or cone-shaped centering projections 58 are provided (FIG. 4), which can be inserted axially into the ends of the tube 23 thereby to remove dents possibly occurring in the end edges of the tube in this area.

The connecting arrangement 44 consists of a plurality of pivot levers, linkages and shafts. As shown particularly in FIGS. 2 and 3, a vertical pivot shaft 46 is fixed for rotational movement on the housing of the service arrangement 14 by means of bearings 45. A pivot lever 47 is frictionally connected to the bottom of this pivot shaft 46, and a second pivot lever 62 is connected to the shaft 46 at the upper end of the positioning arm 15. The lower pivot lever 47 is eccentrically connected to the package ejector shaft 49 via an elongate link 48, which has a lengthwise adjustable main link body with rotary joints 48' at each of its ends. A similar link 51 with rotary joints 51' connects the upper pivot lever 62 with the positioning arm 16 which is pivotably seated on a bracket 50. As already mentioned above, the positioning arm 15 is directly fastened on the pivot shaft 46.

FIG. 4 shows a modified embodiment of the tube positioning device 12 wherein at least one of the positioning arms 15,16 is made in several parts, e.g., front and rear arm portions 52, 53 pivoted together, so that the front arm portion 52 can be angled pivotably in respect to the rear support arm portion 53 by the action of a spring element 54 interposed between the two arm portions. The pivot travel of the arm piece 52 is limited, at least toward the rear, by a stop 55.

Furthermore, a monitoring device 56, for example a light scanner, a limit switch or the like, is provided for monitoring the end position of the positioning arms 15,16. The monitoring device 56 is connected to the control device 57 of the service arrangement 14 and registers when the positioning arms 15,16 do not move into their prescribed end position.

In the area or portion of the positioning arms 15, 16 which contacts with the empty tube 23, the positioning arms 15,16 either have a smooth contact surface 61 or, in the preferred embodiment, conical centering projections 58. During positioning, these conical centering projections 58 are inserted from the axial direction into the end of the tube and in the process remove dents from any tubes which are slightly dented in their end edges. To prevent the tube positioning device 12 from being overloaded and potentially damaged because of greatly defective tubes, the connecting arrangement 44 is provided with an overload limiter 59, preferably in the form of a yieldable spring component in the lengthwise extent of the link 51.

Furthermore, a centering device may be provided for aiding in the proper centered positioning of the tube gripper 28 when disposed in the area of a tube support frame 60, preferably in the form of a fork-shaped centering receptacle 66 disposed by means of appropriate fasteners 68 at the end of each support frame 60, and a compatible finger-like centering projection 65 fixed on the tube gripper 28 by fastening means 67 arranged such that an empty tube held in the gripper element 32 of the tube gripper 28 can be transferred in exactly proper position relative to the bobbin frame 60.

The operation of the present invention may thus be understood. If one of the work positions (i.e., the spinning stations) 3 of the textile machine 1 reports a need for an exchange of a package with an empty tube because the package 9 running on its winding device 5 has reached a prescribed diameter or a predetermined length of yarn has been wound onto the package, the service structure 14 is transported as quickly as possible to this work station and is positioned thereat, all in a known manner.

The tube gripper 28, normally located on the service structure 14 in a resting position I (FIG. 1), is pivoted into the position II and grips an empty tube 23 disposed in a transport receptacle 22 or in a transport trough 63 of the transport unit 18. For such purpose, an appropriate transport unit 18 of the endless transport device 17 is located in a predetermined position at the back of the work station. After gripping the empty tube 23, the tube gripper 28 with the empty tube is moved into an intermediate position III wherein the gripper element 32 of the tube gripper 28 is located within the area of the tube positioning device 12 in which the subsequent package transfer operation will not be hampered.

The service structure 14 now move its bobbin frame opener 26 (FIG.1) under a resiliently seated arm of the tube support holder 60 and pushes it outward, so that the yarn package 9 held between the arms of the tube support holder is released. Thereafter the package is pushed by means of the package ejector 25 in the direction of the transport device 17 and rolls into the V-shaped transport receptacle 22 of the transport unit 18.

The tube positioning device 12 is simultaneously activated by means of the connecting arrangement 44 when the package 9 is pushed out. As shown in FIGS. 2 and 3 in particular, the lever link 48 eccentrically pivoted to the package ejector shaft 49 is actuated to move in the direction B in the course of the outward pivoting of the package ejector 25 in the rotational direction A. The lever linkage 48 thereby turns the pivot shaft 46 by means of the pivot lever 47, which causes the lever link 51 fastened on the pivot lever 62 to move in the direction C and causes the positioning arm 15 to move in the direction D. In addition, the positioning arm 16, which is seated on a pivot pin 64 on a bracket 50, is pivoted in the direction E via the lever link 51.

In their resultant position of the positioning arms 15,16, the empty tube 23 placed between the positioning arms 15,16 is aligned with respect to the bobbin frame 60 of the respective work station 3. The final position of the positioning arms 15,16 is monitored by means of the monitoring device 56 which is in contact with the control device 57 of the service structure 14 (see FIG. 4).

The alternative embodiment of FIG. 4 differs from the embodiment of FIG. 3 essentially only in that at least one of the positioning arms, in this case the positioning arm 16, is made of several parts and in that the ends of the positioning arms 15,16 have cone-shaped centering projections 58 inserted axially into the opposite ends of the tube 23 to remove dents from dented tubes, as already described above. As can be seen from FIG. 4, the arm portion 52 is movably fastened on the support arm 53 via an articulated shaft 65 and is acted upon in the direction G by means of a spring element 54. The pivoting travel of the arm portion 52 toward the rear is limited by a stop 55 disposed on the support arm 53.

Such a design has the advantage, for example, that the tube 23 is already gripped at the start of the pivot movement of the package ejector 25 and is immediately held securely by the action of the spring element 54 whereby, if needed, the tube gripper 28 can release or loosen the grip of its tube gripper element 32, which considerably eases the axial orientation of the empty tube 23. The spring element 54 is then deflected further in the course of additional pivoting of the package ejector 25 until the arm portion 52 comes to rest against the stop 55. The positioning arm 16 is thereby braced and can move into the final position. As the positioning arms 15,16 are pivoted into their final positions by the linkage 51, their cone-shaped projections 58 are pushed into the axial ends of the tube 23 in the process. As in the embodiment of FIG. 3, the final disposition of the positioning arms 15,16 is also monitored by the monitoring device 56 in the embodiment of FIG. 4.

Figure 5:
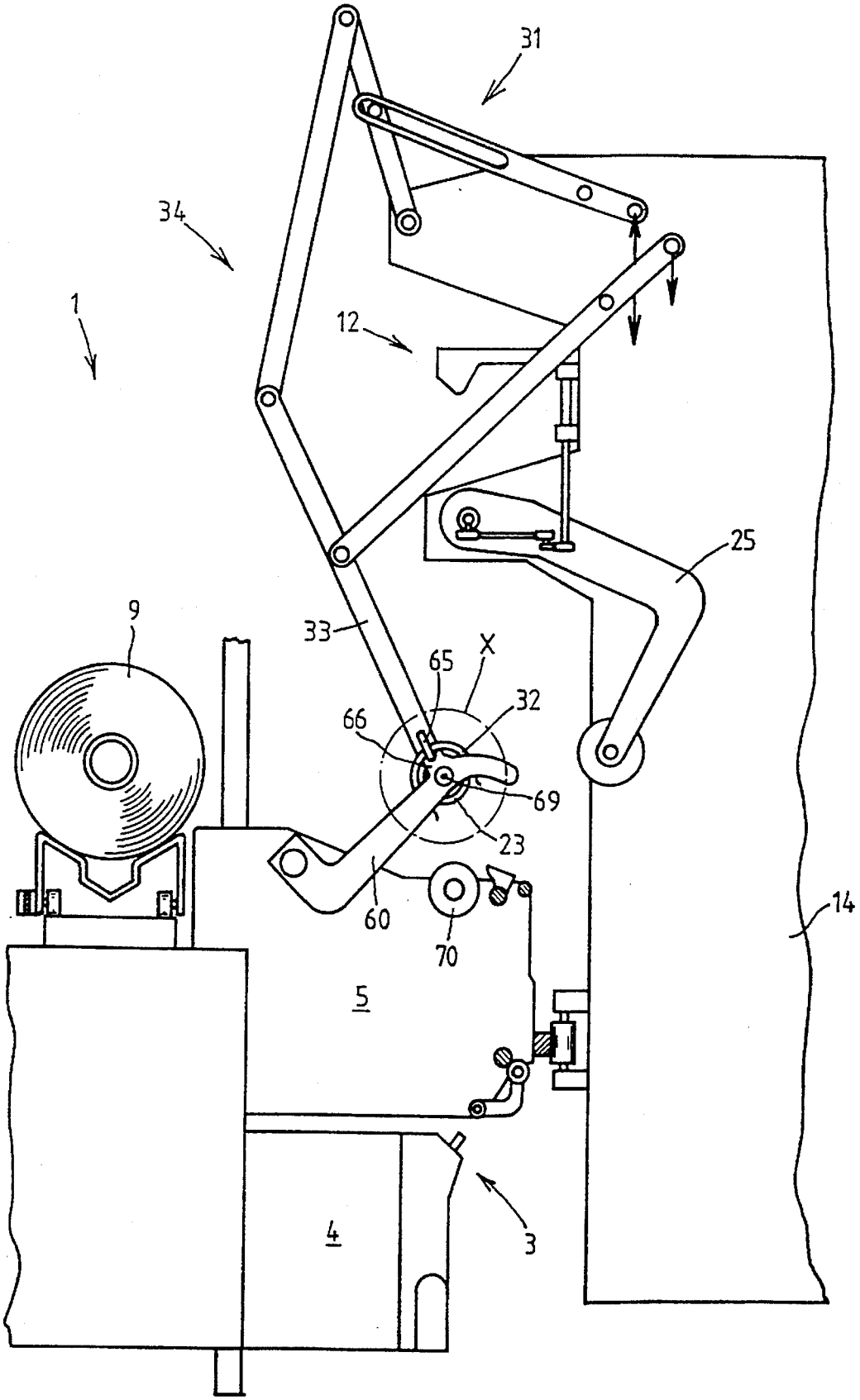
FIG. 5 is an end elevational view of the tube gripper during a tube transfer operation to the bobbin frame.
Figure 6:
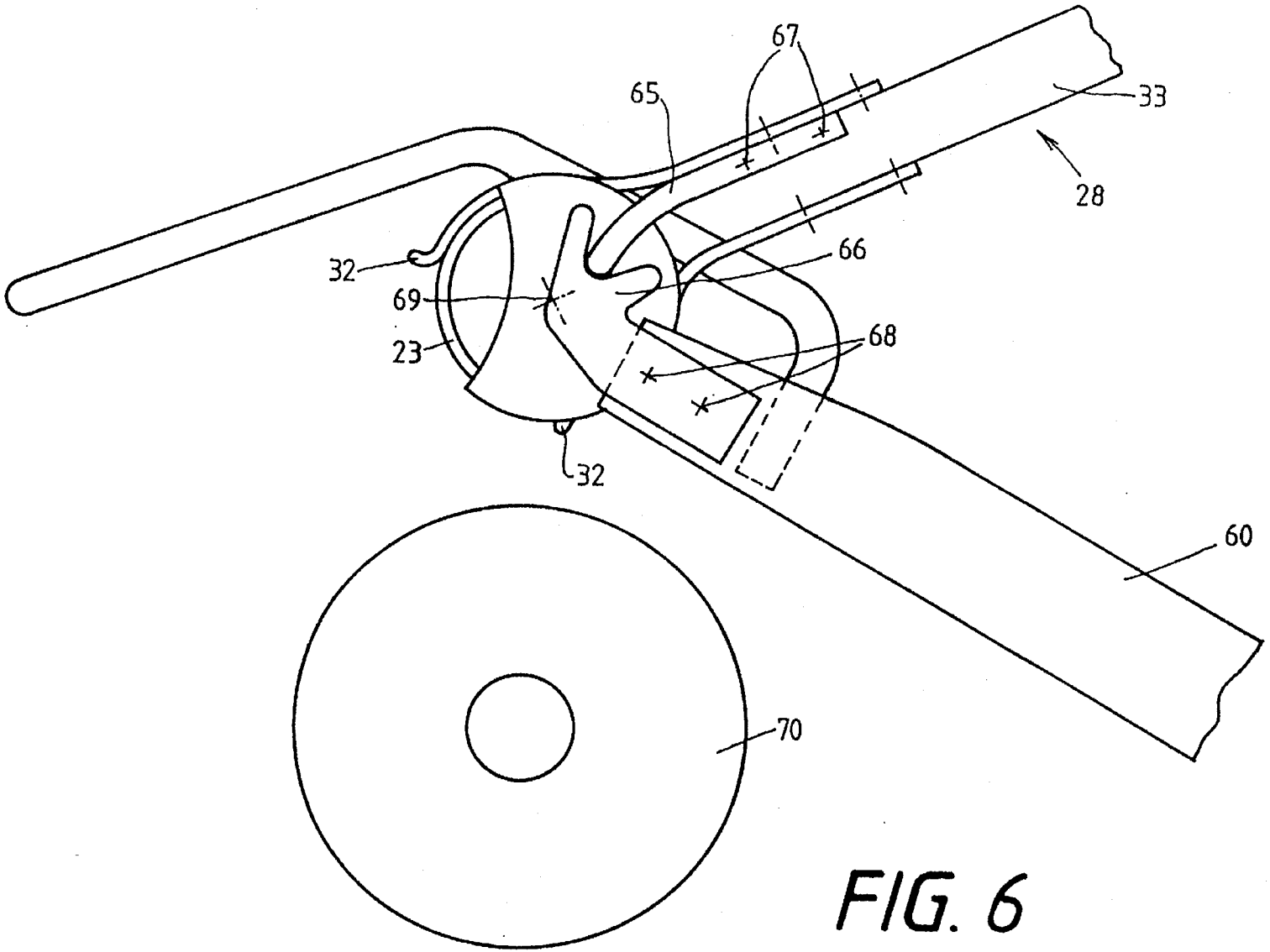
FIG. 6 is a detailed elevational view of the area X of FIG. 5.

The empty tube 26, once axially aligned in the tube positioning device 12, is conveyed by the gripper element 32 of the tube gripper 28 to the tube receptacle of the support frame 60 of the appropriate work station 3, as represented in FIG. 5. At this time, the tube support frame 60 is located slightly above the normal tube transfer position, i.e., at a distance spaced above the yarn guide drum 70. During the movement of the gripper element 32 approaching the bobbin frame 60, the centering projection 65 of the tube gripper 28 disposed alongside the gripper element 32 is moved into the fork-shaped centering receptacle 66 on the bobbin frame 60 and thereby precisely positions the tube gripper element 32 and the tube receptacles of the bobbin frame 60 in correct relation to one another.

As will be understood, structurally changed embodiments or combinations of the above described embodiments are easily conceivable without departing from the scope of the present invention and thus the present invention is not limited to the exemplary embodiments described above. For example, it is quite advantageous to equip the ends of the positioning arms represented in FIG. 3 with cone-shaped centering projections whether or not one or both of the arms are formed of multiple arm portions.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In a yarn package-producing textile machine having multiple work stations each equipped with a bobbin tube support frame, an endless transport arrangement for delivering empty tubes to the work stations and for removing finished yarn packages from the work stations and a service structure movable between the work stations for performing replacement of finished packages with empty tubes, the service structure having a tube gripper and a tube positioning device the tube gripper transporting an empty tube from the endless transport arrangement to the tube positioning device and the tube positioning device having a pair of opposing pivotable positioning arms engageable with opposite ends of the empty tube for receiving the empty tube from the tube gripper and for orienting the empty tube into an exact position relative to the tube support frame of a respective work station to be supplied with the empty tube.

2. A yarn package-producing textile machine in accordance with claim 1, wherein the service structure includes a package ejector for displacing finished yarn packages from the work stations of the machine and the positioning arms are connected via a connecting linkage to the package ejector of the service structure.

3. A yarn package-producing textile machine in accordance with claim 2, wherein the connecting linkage is arranged to pivot the positioning arms, simultaneously with actuation of the package ejector, into a predetermined position wherein the positioning arms are aligned in a positionally exact relation to the tube support frame of a respective work station to be supplied with an empty tube.

4. A yarn package-producing textile machine in accordance with claim 2, wherein the tube positioning device includes a pivot shaft rotationally supported in generally vertical disposition on the service structure and connected with the package ejector by an eccentric drive linkage.

5. A yarn package-producing textile machine in accordance with claim 4, wherein one of the positioning arms is fastened on the pivot shaft.

6. A yarn package-producing textile machine in accordance with claim 5, wherein the other positioning arm is pivotably seated on a bracket and is connected with the pivot shaft by means of another drive linkage.

7. A yarn package-producing textile machine in accordance with claim 2, wherein the tube positioning device includes a monitoring device connected to a control device for the service structure for monitoring the disposition of the positioning arms.

8. A yarn package-producing textile machine in accordance with claim 2, wherein the positioning arms have cone-shaped centering projections for insertion into axial end openings of an empty tube.

9. A yarn package-producing textile machine in accordance with claim 2, wherein the connecting linkage includes means for yielding to overloading forces on the connecting linkage.

10. A yarn package-producing textile machine in accordance with claim 1, wherein at least one of the two positioning arms comprises multiple arm portions including a support arm portion and an end arm portion pivotably fastened on the support arm portion and a spring biasing element for urging the arm portions into a predetermined relative position.

11. A yarn package-producing textile machine in accordance with claim 10, wherein the at least one positioning arm includes a stop element disposed on the support arm portion for limiting pivotal movement of the end arm portion and for bracing the end arm portion.

12. A yarn package-producing textile machine in accordance with claim 1, wherein the service structure includes a tube gripper having a centering projection and the tube support frame of each work station includes a centering receptacle for receiving the centering projection when the tube gripper is disposed at the tube support frame.

13. A yarn package-producing textile machine in accordance with claim 12, wherein the centering receptacle disposed on the tube support frame is shaped as a fork and the centering projection on the tube gripper is shaped as a finger.

14. A yarn package-producing textile machine in accordance with claim 12, wherein the centering projection and the centering receptacle are cooperatively configured and arranged to assure that an empty tube held in the tube gripper is positioned coaxially relative to an axis of rotation of a tube support holder of the tube support frame.

* * * * *